US007922177B2

(12) United States Patent
Payne et al.

(10) Patent No.: US 7,922,177 B2
(45) Date of Patent: Apr. 12, 2011

(54) TICKET STRIPS THAT ENCOURAGE MULTIPLE TICKET PURCHASING

(75) Inventors: Fred A. Payne, Pasadena, CA (US); William F. Breslo, Topanga, CA (US); James A. Breslo, Torrance, CA (US)

(73) Assignee: Diamond Game Enterprises, Inc., Chatsworth, CA (US)

( * ) Notice: Subject to any disclaimer, the term of this patent is extended or adjusted under 35 U.S.C. 154(b) by 1114 days.

(21) Appl. No.: 11/436,199

(22) Filed: May 17, 2006

(65) Prior Publication Data

US 2006/0261546 A1 Nov. 23, 2006

Related U.S. Application Data

(60) Provisional application No. 60/682,106, filed on May 18, 2005.

(51) Int. Cl.
*A63B 71/00* (2006.01)

(52) U.S. Cl. ..... 273/139

(58) Field of Classification Search ..... None
See application file for complete search history.

(56) References Cited

U.S. PATENT DOCUMENTS

| | | | | | |
|---|---|---|---|---|---|
| 3,900,219 | A * | 8/1975 | D'Amato et al. | 283/101 |
| 3,917,276 | A * | 11/1975 | Green Barg | 273/139 |
| 3,940,124 | A * | 2/1976 | Johnsen | 493/335 |
| 3,945,870 | A * | 3/1976 | Johnsen | 156/201 |
| 3,956,049 | A * | 5/1976 | Johnsen | 156/200 |
| 4,012,268 | A * | 3/1977 | Johnsen | 156/200 |
| 4,033,611 | A * | 7/1977 | Johnsen | 283/101 |
| 4,039,122 | A * | 8/1977 | Johnsen | 229/69 |
| 4,768,810 | A * | 9/1988 | Mertens | 462/26 |
| 4,840,306 | A * | 6/1989 | Lombardo | 229/304 |
| 4,951,864 | A * | 8/1990 | Dicker | 229/80 |
| 5,029,901 | A * | 7/1991 | Dotson et al. | 462/55 |
| 5,118,030 | A * | 6/1992 | McNamara et al. | 229/69 |
| 5,125,689 | A * | 6/1992 | Heninger | 283/106 |
| 5,314,110 | A * | 5/1994 | Lombardo | 229/92.1 |
| 5,360,159 | A * | 11/1994 | Perriman | 229/92.3 |
| 5,366,410 | A * | 11/1994 | Lombardo | 462/6 |
| 5,376,048 | A * | 12/1994 | Whiteside | 462/6 |
| 5,464,255 | A * | 11/1995 | Schildmeyer | 283/116 |
| 5,578,353 | A | 11/1996 | Drew, III | |
| 5,716,688 | A * | 2/1998 | Burke et al. | 428/43 |
| 5,893,512 | A * | 4/1999 | Diedrich | 229/92.1 |
| 5,941,451 | A * | 8/1999 | Dexter | 229/92.1 |
| 6,131,802 | A * | 10/2000 | Lombardo | 229/92.1 |
| 6,305,687 | B1 * | 10/2001 | Pollock et al. | 273/269 |
| 6,322,103 | B1 * | 11/2001 | Li et al. | 280/777 |
| 6,422,938 | B1 * | 7/2002 | Steitz | 462/18 |
| 6,431,437 | B1 * | 8/2002 | Lombardo et al. | 229/305 |
| 6,474,694 | B1 * | 11/2002 | Emmert et al. | 283/56 |
| 6,948,742 | B2 * | 9/2005 | Buck | 283/56 |
| 2003/0049403 | A1 * | 3/2003 | Crum et al. | 428/42.3 |

* cited by examiner

*Primary Examiner* — Gene Kim
*Assistant Examiner* — Dolores Collins
(74) *Attorney, Agent, or Firm* — Panitch Schwarze Belisario & Nadel LLP

(57) ABSTRACT

Strips of two-ply instant lottery tickets are provided that have features which encourage multiple ticket purchases. Strips of purchased tickets can be opened in one motion, revealing the ticket results without needing to scratch off any material. Ruler markings along edges of the strips of tickets, and ticket indicia that spans multiple tickets further encourage multiple ticket purchases. Security panels flank one or more edges of the tickets which discourage tampering with unpurchased tickets.

23 Claims, 13 Drawing Sheets

TICKET STRIPS THAT ENCOURAGE MULTIPLE TICKET PURCHASING

CROSS-REFERENCE TO RELATED APPLICATIONS

This application claims the benefit of U.S. Patent Application No. 60/682,106, filed on May 18, 2005, entitled "Ticket Strips That Encourage Multiple Ticket Purchasing."

BACKGROUND OF THE INVENTION

The present invention relates to chance-type tickets that are dispensed in a strip format.

Lottery tickets and pull tab tickets are manufactured in many different formats. One popular format is to manufacture the tickets in strips with perforations between adjacent tickets to allow individual tickets to be torn from the strip. The strip may be stored as a reel of tickets or as a fanfolded or accordion-folded stack of tickets and may be dispensed from a machine or manually by a clerk. Scratch-off instant lottery tickets are typically a single ply ticket and are played by removing a rub-off covering on the face of the ticket. Pull tab tickets may have two plies with cut-outs in the top ply that define windows. The pull tab tickets are played by opening the windows to reveal game results.

Typically, all of the tickets in the strip are associated with a single deal of tickets. Each deal has a predetermined number of winning tickets.

Diamond Game Enterprises, Inc., Chatsworth, Calif., markets phone cards manufactured in two-ply strips. FIGS. 1A-1D show a strip 10 of one commercial embodiment of the phone cards 12 which is called "Bayou Bucks." In Bayou Bucks, each phone card 12 costs $1.00 and entitles the user to three minutes of talk time. In addition to receiving phone talk time, each phone card 12 has an instant sweepstakes that provides the phone card purchaser with the chance to win a fixed, predetermined monetary prize. Bayou Bucks phone cards 12 are interconnected end-to-end with rows of perforations 14 that extend widthwise across the strip 10 and that separate and define individual phone cards 12. Each phone card 12 has a top ply 16 and a base ply 18. Each phone card 12 is thus defined by front and rear surfaces 20 and 22 of the top ply, and front and rear surfaces 24 and 26 of the base ply. The front surface 20 of the top ply 16 has the phone card value ($1.00) and a top prize value 28 for the sweepstakes game. The front surface 24 of the base ply 18 has calling card instructions 29, PIN number 30 for use of the phone card, and sweepstakes game results 32 thereon, all of which are hidden from view by the top ply 16.

The phone cards 12 are dispensed in a vending machine (not shown), either one at a time or in a strip 10 if a plurality of phone cards 12 are purchased in one transaction.

Referring to FIG. 2, an adhesive 34 is disposed between portions of the adjoining surfaces of the top ply 16 and the base ply 18. During assembly of the phone card 12, the adhesive 34 is placed on the front surface 24 of the base ply 18 before the top ply 16 is adhered to the base ply 18. The adhesive 34 covers substantially all areas of the front surface 24, except for an edge region 36 that aligns with an edge region 38 of the top ply 18. That is, the adhesive 34 extends all of the way to a first edge (e.g., the left edge), but does not extend all of the way to a second edge (e.g., the right edge). The edge region 38 includes "PULL HERE" opening instructions.

The adhesive 34 is sufficiently weak so that if the top ply 16 of a phone card 12 at the end of the strip 10 is pulled perpendicular to the perforations, the top ply 16 of all of the phone cards 12 in the strip 10 release from their respective base plies 18 in one continuous strip and without severing any of the rows of perforations 14 associated with the plurality of phone cards 12. In this manner, the calling card instructions 29, PIN number 30 for use of the phone card, and sweepstakes game results 32 on the front surface 24 of the base ply 18 of each phone card 12 in the strip 10 become simultaneously revealed with one motion. By "simultaneously," one does not mean that the front surface 24 of all phone cards 12 are instantly revealed, but that in one quick motion, all of the front surfaces 24 of all phone cards 12 become exposed. This is in contrast to having to perform a plurality of discrete motions to individually reveal each front surface 24 of each phone card 12, such as by individually removing the top ply 16 of each phone card 12 in the case where a plurality of phone cards 12 were purchased in one transaction.

To open a single phone card 12, the top ply 16 and base ply 18 are separated at any edge, such as at the edge region 38 which has no adhesive 34 between plies, and the plies are released from each other. A single phone card 12 may also be separated at any of the other three edges by pulling the plies apart from each other and then releasing the plies from each other. If a strip 10 of phone cards 12 are purchased, the phone card 12 at the end of the strip 10 is opened in either of these ways and then the remaining phone cards 12 may be opened in one quick motion as described above.

The adhesive 34 has chemical properties such that after the plies are separated, the adhesive 34 loses its adhesive properties, and thus the plies cannot be stuck back together by using the original adhesive 34.

Referring again to FIGS. 1A-1D and FIG. 2, the perforations 14 extend widthwise across the top ply 16 and the base ply 18 of the strip 10, and the adhesive 34 is disposed throughout the adjoining surfaces of the top ply 16 and base ply 18, except the edge region 38. In this manner, the strip 10 of phone cards 12 can be severed at any point without separating the top ply 16 from the base ply 18 so that any number of phone cards 12 on the strip 10 can be purchased without revealing the information on the front surface 24 of the base ply 18 unless the two plies 16, 18 are deliberately separated. In FIG. 1D, the hatched region is preferably opaque, which can be achieved by covering the entire region with solid black ink.

The phone cards 12 described above are not instant lottery tickets. An instant lottery ticket is purchased for the sole purpose of trying to win money or prizes associated with the lottery. An instant lottery ticket must be purchased. In contrast to a lottery, the instant sweepstakes associated with the phone cards 12 is a freebie (i.e., something that is free, usually provided as part of a promotional scheme), and is analogous to bottle cap contests that award prizes on specially marked soft drink containers. The phone cards 12 state "No purchase necessary to win," further emphasizing the freebie nature of the phone card sweepstakes. That is, a free sweepstakes ticket portion is available by making a written request to the sweepstakes management entity, in accordance with state regulations governing sweepstakes and contests.

Despite the large number of different types of conventional instant lottery tickets and pull tab tickets commercially available today, there is still a need for additional formats of instant lottery tickets and pull tab tickets, and particularly formats that encourage purchase of multiple tickets in a single transaction and simultaneously meet the strict standards of state lottery commissions for ticket security. The present invention fulfills such a need.

Many recently introduced scratch-off instant lottery tickets, such as tickets that have match up games, have an even larger number of regions that must be scratched off that previous scratch-off tickets. Consequently, these tickets take even longer to play that previous scratch-off tickets. There is a need for instant lottery tickets that are quicker to play than scratch-off tickets but which provide a similar match up game experience. The present invention also fulfills this need.

BRIEF SUMMARY OF THE INVENTION

Strips of two-ply instant lottery tickets are provided that have features which encourage multiple ticket purchases. Strips of purchased tickets can be opened in one motion, revealing the ticket results without needing to scratch off any material. Ruler markings along edges of the strips of tickets, and ticket indicia that spans multiple tickets further encourage multiple ticket purchases. Security panels flank one or more edges of the tickets which discourage tampering with unpurchased tickets.

BRIEF DESCRIPTION OF THE DRAWINGS

The foregoing summary, as well as the following detailed description of preferred embodiments of the invention, will be better understood when read in conjunction with the appended drawings. For the purpose of illustrating the invention, there is shown in the drawings embodiments which are presently preferred. However, the invention is not limited to the precise arrangements and instrumentalities shown.

In the drawings.

DETAILED DESCRIPTION OF THE INVENTION

Certain terminology is used herein for convenience only and is not to be taken as a limitation on the present invention.

Figure 3B:
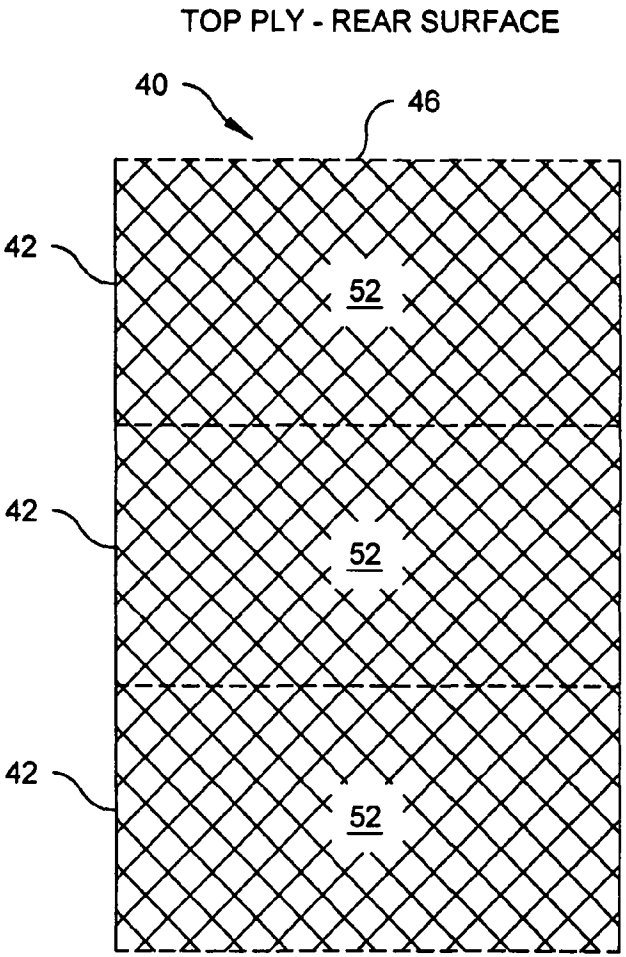
FIGS. 3A-3D shows the front and rear surfaces of the top ply and base ply of a strip of instant lottery tickets in accordance with one preferred embodiment of the present invention.
Figure 3A:
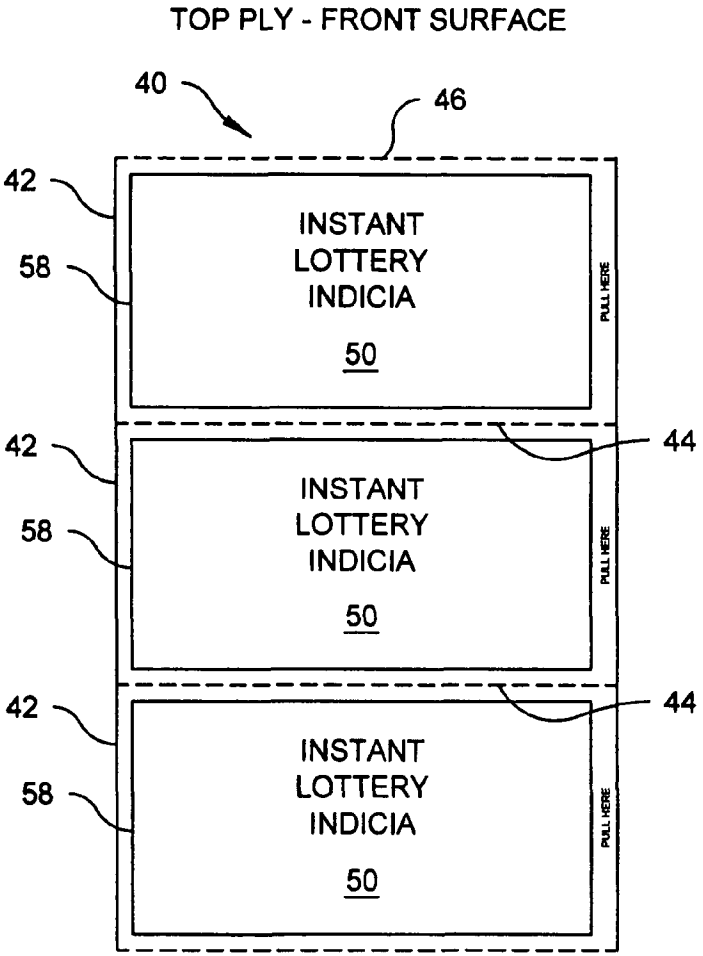
Figure 3D:
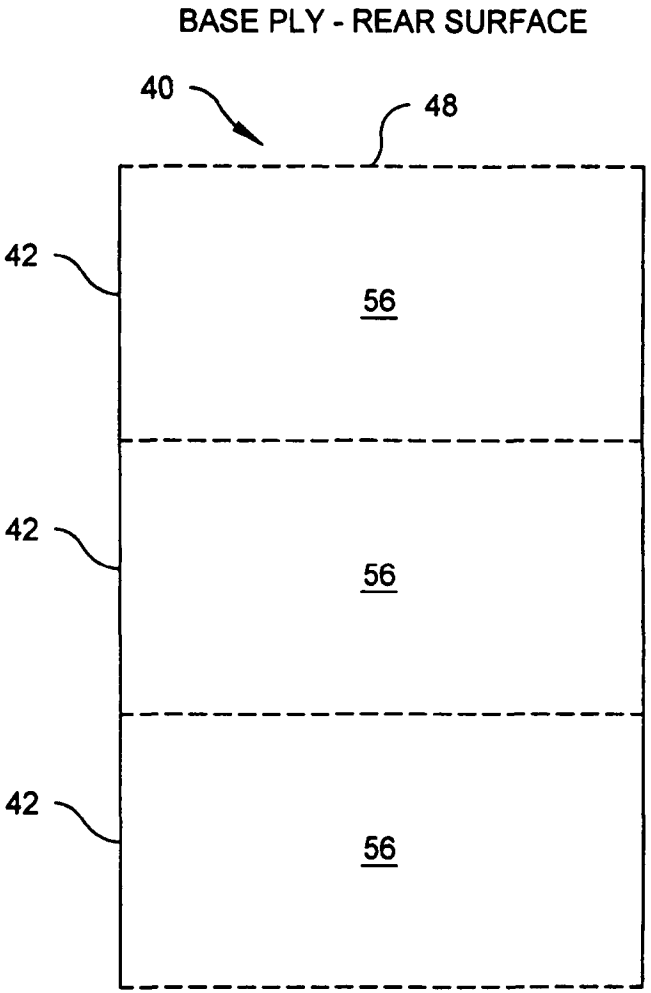
Figure 3C:
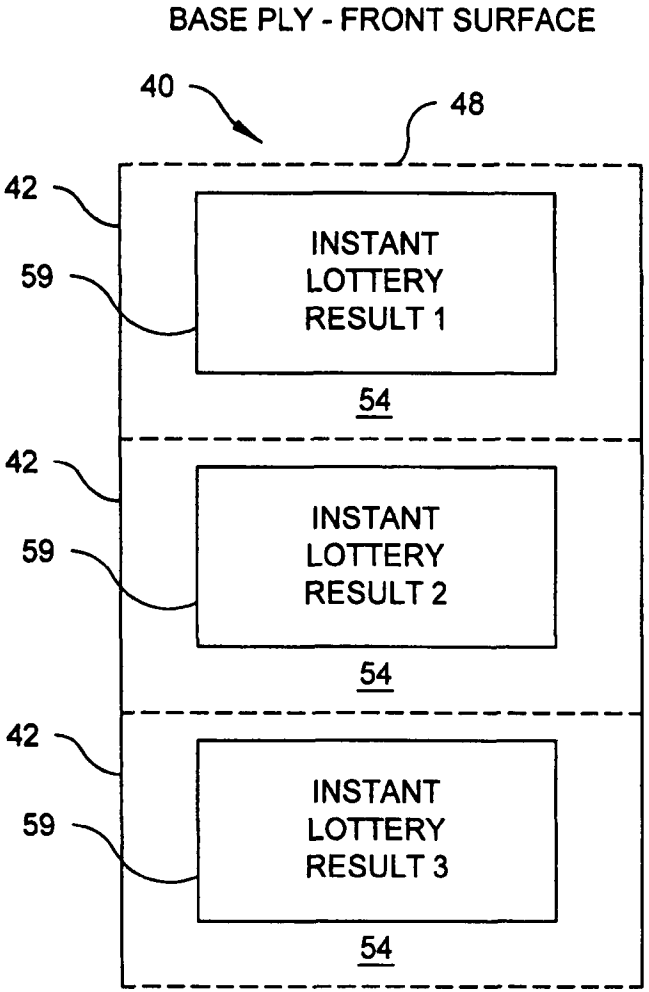

FIGS. 3A-3D show a strip 40 of two-ply instant lottery tickets 42 in accordance with one preferred embodiment of the present invention." The lottery tickets 42 are interconnected end-to-end with rows of perforations 44 that extend widthwise across the strip 40 and that separate and define individual lottery tickets 42. Each lottery ticket 42 has a top ply 46 and a base ply 48, each with a front and rear surface 50, 52, 54, 56. The front surface 50 of the top ply 46 has pre-printed lottery indicia 58, such as the name of the lottery, the ticket amount, and graphics. The front surface 54 of the base ply 48 has pre-printed instant lottery results 59 which are hidden from view by the top ply 46. The instant lottery results 59 are preferably determined from a deal of lottery results as is well-known in the art. In FIG. 3B, the hatched region is preferably opaque, which can be achieved by covering the entire region with solid black ink.

The lottery tickets 42 may be dispensed in a vending machine (not shown), either one at a time or in a strip 40 if a plurality of lottery tickets 42 are purchased in one transaction.

Figure 4:
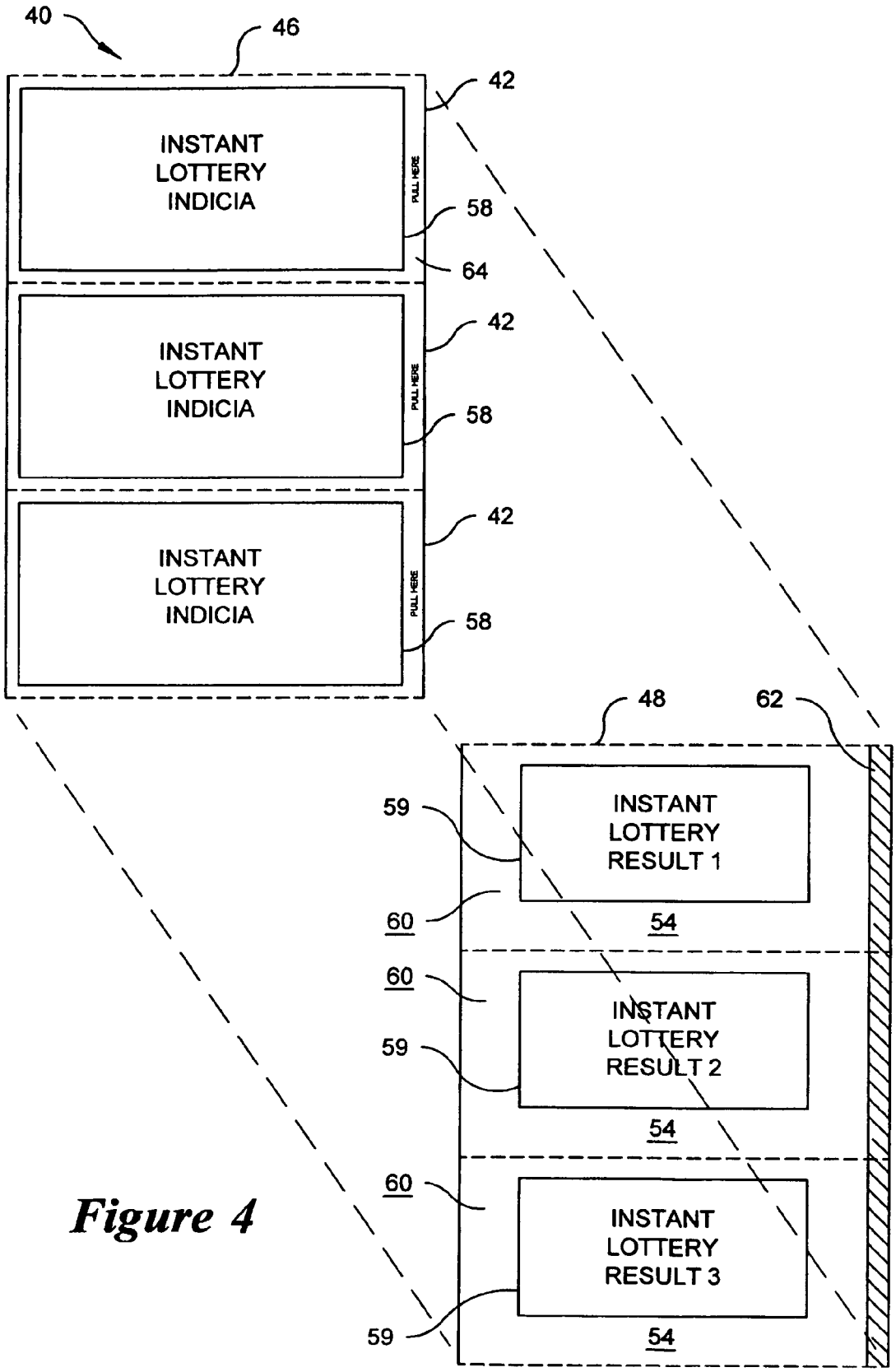
FIG. 4 shows an exploded view of a strip of instant lottery tickets shown in FIGS. 3A-3D.

FIG. 4 shows an exploded view of a strip 40 of instant lottery tickets 42 shown in FIGS. 3A-3D. Referring to FIG. 4, an adhesive 60 is disposed between portions of the adjoining surfaces of the top ply 46 and the base ply 48. During assembly of the lottery ticket 42, the adhesive 60 is placed on substantially all of the front surface 54 of the base ply 48 before the top ply 46 is adhered to the base ply 48. The adhesive 60 is sufficiently weak so that if the top ply 46 of a lottery ticket at the end of the strip 40 is pulled perpendicular to the perforations, the top ply 46 of all of the lottery tickets 42 in the strip 40 release from their respective base plies 48 in one continuous strip and without severing any of the rows of perforations 44 associated with the plurality of lottery tickets 42. In this manner, the instant lottery results 58 can be simultaneously revealed with one motion. By "simultaneously," one does not mean that the front surface 54 of all lottery tickets 42 are instantly revealed, but that in one quick motion, all of the front surfaces 54 of all lottery tickets 42 become exposed. This is in contrast to having to perform a plurality of discrete motions to individually reveal each front surface 54 of each lottery ticket 42, such as by individually removing the top ply 46 of each lottery ticket 42.

Referring again to FIGS. 3A-3D and FIG. 4, the perforations 44 extend widthwise across the top ply 46 and the base ply 48 of the strip 40, and the adhesive 60 is disposed throughout the adjoining surfaces of the top ply 46 and base ply 48. In this manner, the strip 40 of lottery tickets 42 can be severed at any point without separating the top ply 46 from the base ply 48 so that any number of lottery tickets 42 on the strip 40 can be purchased without revealing the instant lottery results 59 unless the two plies 46, 48 are deliberately separated.

To open a single lottery ticket 42, the top ply 46 and base ply 48 are separated at any edge until there is sufficient separation to release the plies from each other. If a strip 40 of lottery tickets 42 are purchased, the lottery ticket 42 at the end of the strip 40 is opened in this manner and then the remaining lottery tickets 42 may be opened in one quick motion as described above.

Figure 5:
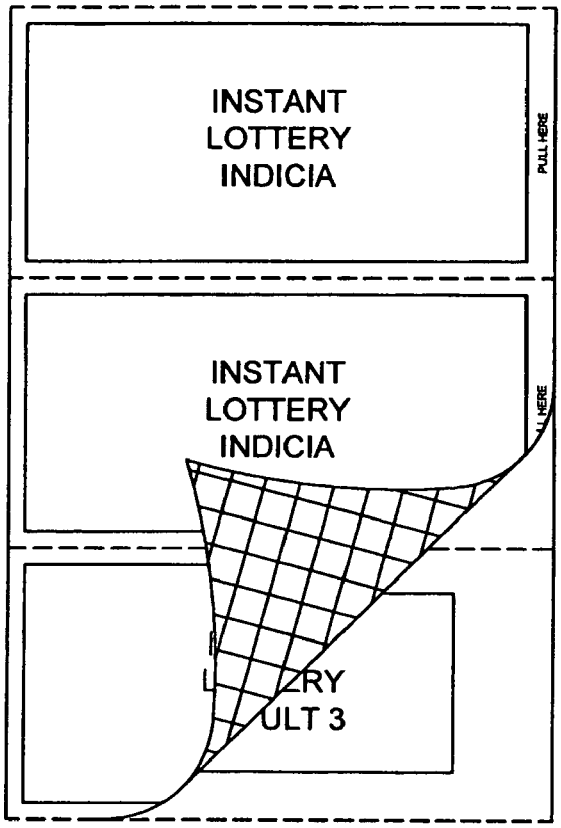
FIG. 5 shows a peel-away view of the strip of tickets in FIG. 4 as they are being opened.

FIG. 5 shows a peel-away view of the strip 40 of lottery tickets 42 as it is being opened.

The above-described lottery ticket 42 will appeal to persons who do not wish to play scratch-off instant lottery tickets due to the inconvenience and messiness of the scratch off process, particularly if a large number of instant lottery tickets are purchased. Using the above-described strip 40 of lottery tickets 42, a lottery player may purchase a plurality of ticket 42 and may very quickly determine if any of the tickets 42 are winners.

In one version of this embodiment depicted in FIG. 4, there is no adhesive 60 between the plies at edge region 62 of the base ply 48 that aligns with an edge region 64 of the top ply 46 so that the plies can be easily separated in the same manner as described above with respect to the prior art phone cards 10. That is, the adhesive 60 extends all of the way to a first edge (e.g., the left edge), but does not extend all of the way to a second edge (e.g., the right edge).

State lottery commissions are particularly concerned about security issues regarding instant lottery tickets. One primary concern is that the tickets themselves be tamper-resistant and/or tamper-evident so that the ticket cannot be easily inspected to determine whether or not it is a winner before it is purchased, and if it is tampered with, evidence of tampering will be noticeable to the clerk and/or purchaser. Other versions of this embodiment include tamper-resistant and/or tamper-evident features to address these concerns.

One tamper minimizing/tamper-detecting feature was discussed above and includes providing adhesive 60 between the entire (i.e., substantially all) adjoining surface areas of the top ply 46 and the base ply 48, including the edge regions 62 and 64. By using an adhesive 60 that loses its adhesive properties after the plies are separated, the plies cannot be stuck back together using the original adhesive 60. Attempts to reglue the plies using new adhesive may be noticeable to the clerk and/or purchaser.

Figure 6B:
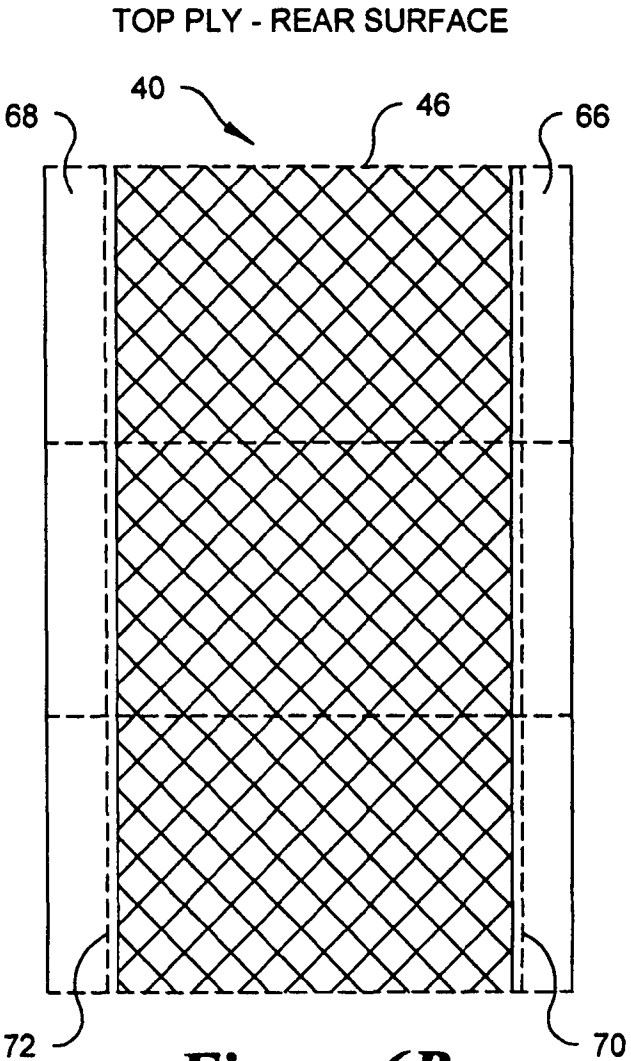
FIGS. 6A-6D shows the front and rear surfaces of the top ply and base ply of a strip of instant lottery tickets in accordance with another preferred embodiment of the present invention.
Figure 6A:
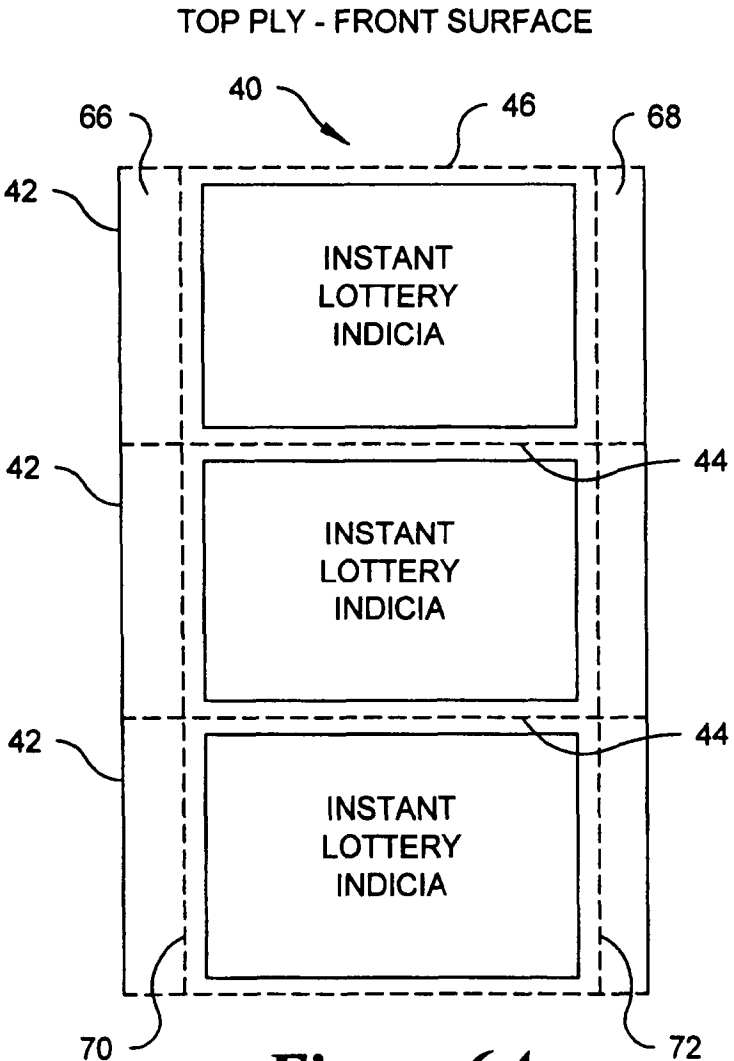
Figure 6D:
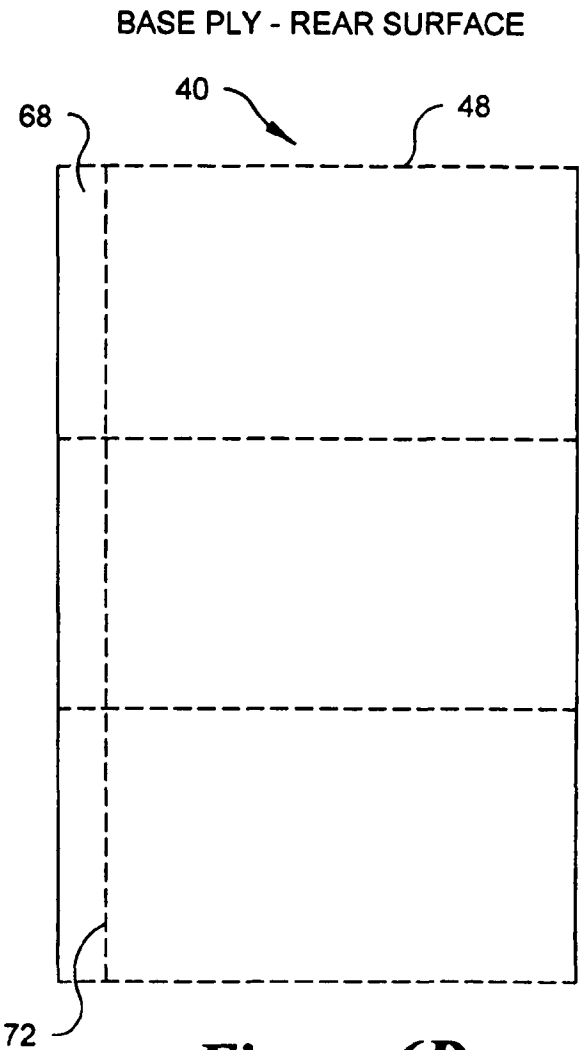
Figure 6C:
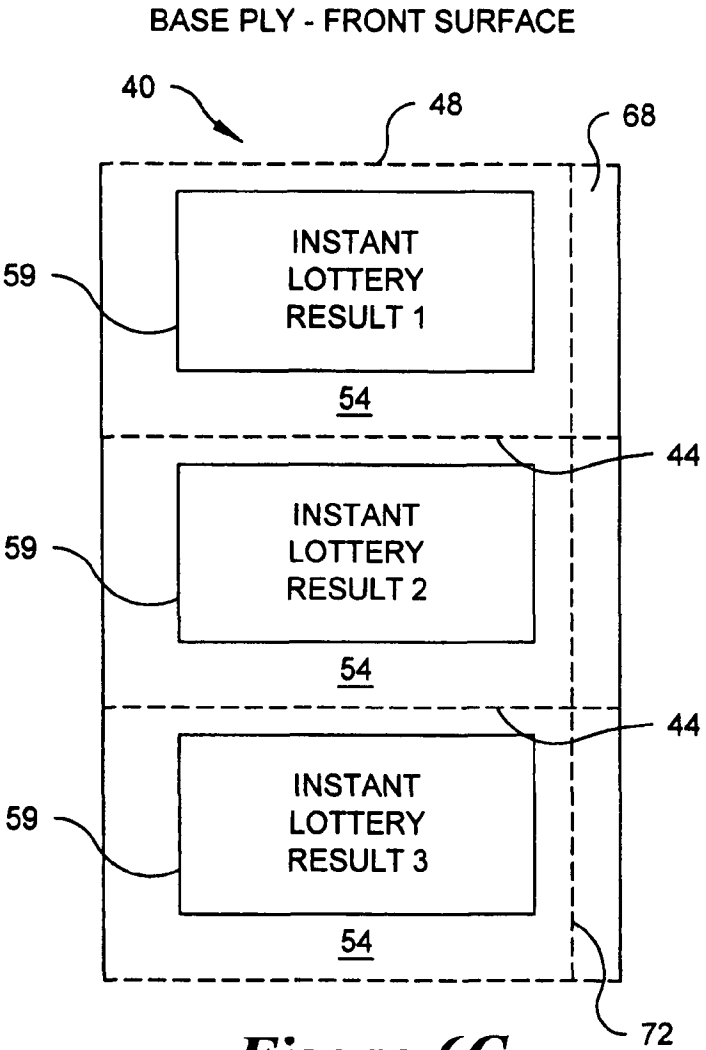

FIGS. 6A-6D show another tamper minimizing/tamper-detecting feature. The strips 40 of tickets 42 are similar to embodiment shown in FIGS. 3A-3D and FIG. 4 except that first and second security panels or tear strips 66 and 68 flank opposite edges of the plies, and longitudinal perforations 70 and 72 extend lengthwise along the strip 40 of tickets 42 between outer edges of the lottery tickets 42 and inner edges of the security panels 70 and 72. The perforations 72 of one of the security panels (the right edge security panel 68 in FIGS. 6A-6D) extend through the top ply 46 and the base ply 48, thereby allowing the security panel 72 of each ticket 42 to be completely torn off. The perforations 70 of the other security panel (the left edge security panel 66 in FIGS. 6A-6D) extend only through the top ply 46, thereby inhibiting the security panel 66 from being torn off. In this manner, if the security panel 68 of an end ticket 42 in the strip 40 is torn off and the top ply 46 of the end ticket 42 is pulled perpendicular to the widthwise perforations 44, the top ply 46 of all of the tickets 42 in the strip 10 release from their respective base plies 48 in one continuous strip and without severing any of the rows of perforations 44 associated with the plurality of tickets 42. The instant lottery results 59 for the strip 40 of tickets 12 would thereby be simultaneously revealed with one motion. In FIG. 6B, the hatched region is preferably opaque, which can be achieved by covering the entire region with solid black ink.

Figure 7:
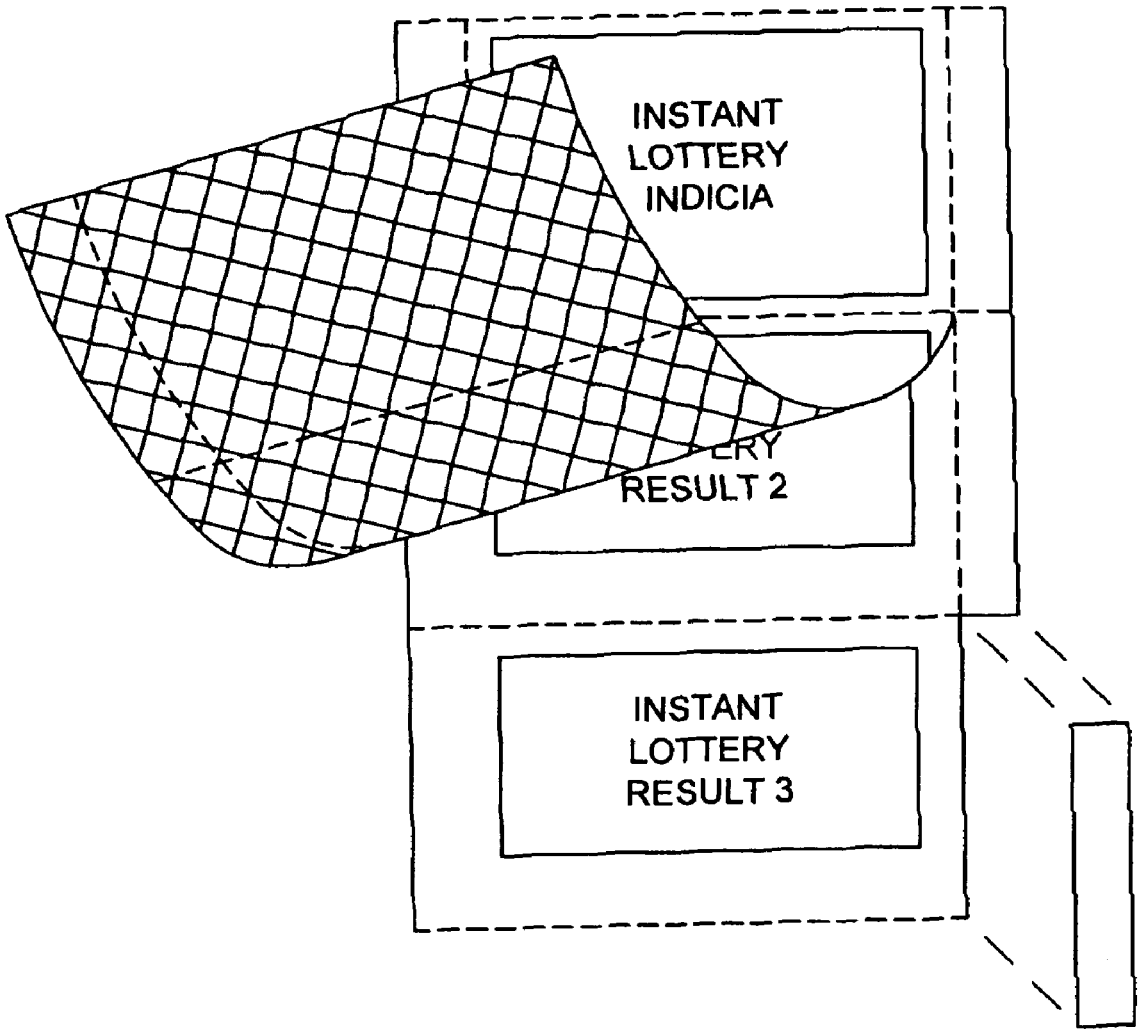
FIG. 7 shows a peel-away view of the strip of tickets in FIGS. 6A-6D as they are being opened.

FIG. 7 shows a peel-away view as the strip 40 of tickets 42 is being opened and also shows that the security panel 68 of an end ticket 42 in the strip 40 is torn off before the plies are separated.

In an alternative embodiment of the present invention shown in FIGS. 6A-6D and FIG. 7, the perforations of both security panels 66 and 68 extend through both the top ply 46 and the base ply 48. In this double perforation embodiment, either the security panels 66 or 68 of an end ticket 42 in the strip 40 may be removed before the plies are separated.

In all of the embodiments shown and described with respect to FIGS. 6A-6D, the adhesive 60 is preferable used in the same manner as described with respect to the embodiment of FIGS. 3A-3D. The security panels 66 and 68 inhibit the ability to view the lottery results 59 while the tickets are still attached to a strip 40. If no adhesive 60 is used, it would still be possible to peek inside one or more end tickets 42 of a strip 40. If adhesive 60 is used over substantially all of the front surface 54 of the base ply 48 before the top ply 46 is adhered to the base ply 48, a strip 40 of tickets 42 can be opened by separating the plies of an end ticket 42 of the strip 40 at either its bottom edge or right edge (assuming that the removable security panel 68 is on the right side of the ticket 42), and then pulling apart the plies of the strip 40 as described above.

If security concerns regarding inappropriate viewing of the end tickets are not present, then the adhesive 60 need not be used, since the security panels 66 and 68 provide a decent frontline defense against easy tampering.

Figure 8:
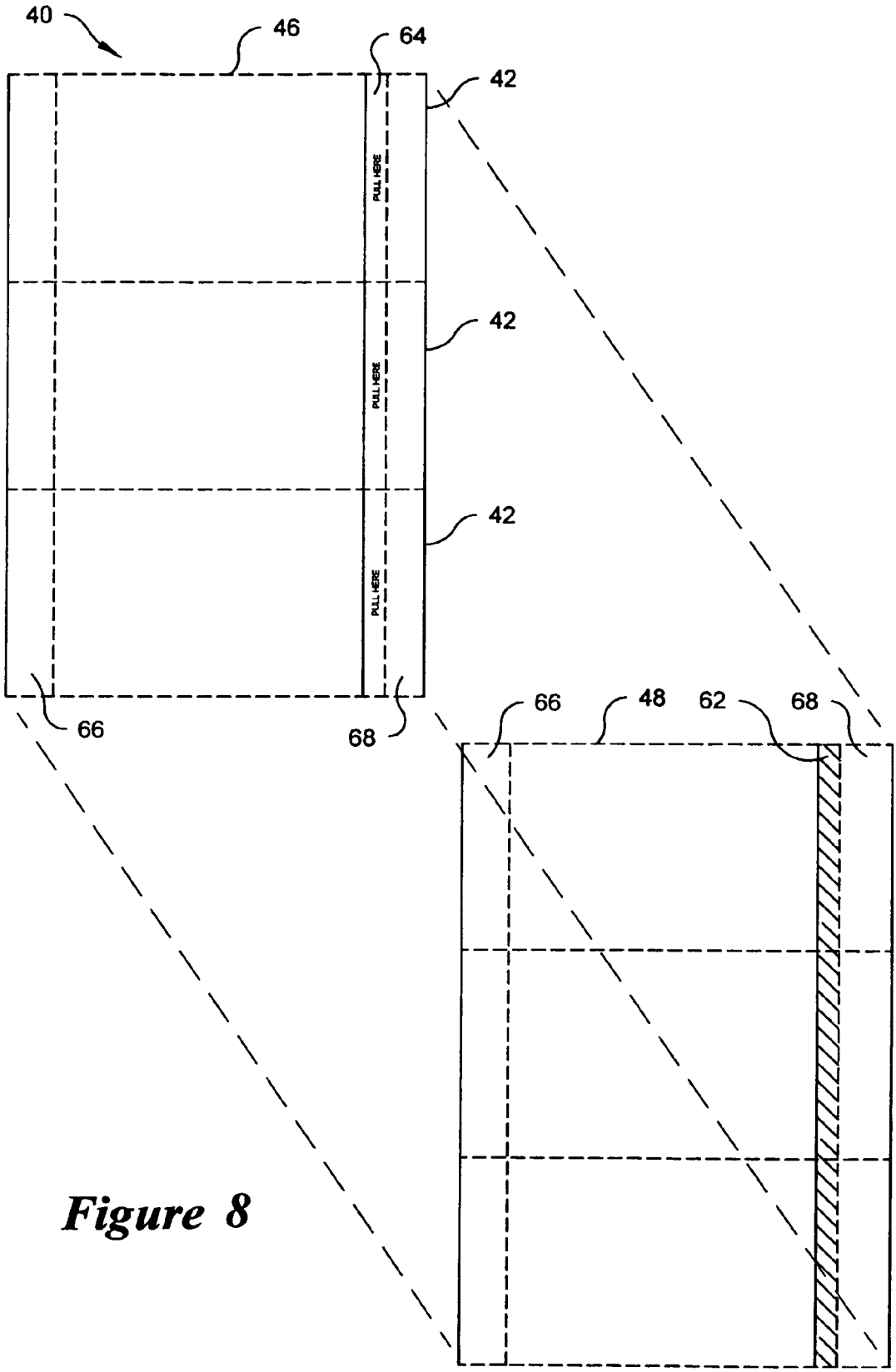
FIG. 8 shows an exploded view of a strip of tickets in accordance with another preferred embodiment of the present invention.

FIG. 8 shows another alternative embodiment of the present invention which is similar to the embodiment shown in FIGS. 6A-6D, except that there is no adhesive 60 between the plies at an edge region 62 of the base ply 48 that aligns with an edge region 64 of the top ply 46 so that the plies can be easily separated in the same manner as described above with respect to the prior art phone cards 10 and instant lottery ticket strips. That is, the adhesive 60 extends all of the way to a first edge (e.g., the left edge), but does not extend all of the way to a second edge (e.g., the right edge). The edges referred to immediately above are the edges of each ticket 42, not including the security panels 66 and 68, also referred to herein as the "inside edges" of the tickets 42. This embodiment allows a ticket to be more easily opened after a security panel 68 is removed. In the double perforation embodiment, there may be edge regions 62 and 64 on both edges of the tickets 42 that are not initially adhesively joined so that the tickets may be more easily opened regardless of which security panel 66 or 68 is removed during the ticket opening process.

FIGS. 9A-9C and FIGS. 10A-10C show alternative embodiments of the present invention designed to encourage purchase of multiple tickets in a single transaction.

Figure 9C:
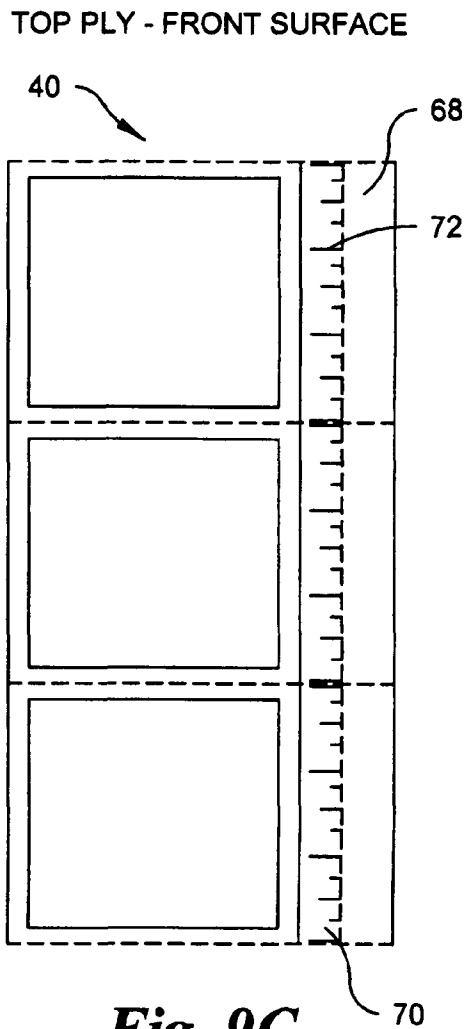
FIGS. 9A-9C show strips of tickets having ruler markings thereon in accordance with another embodiment of the present invention.
Figure 9B:
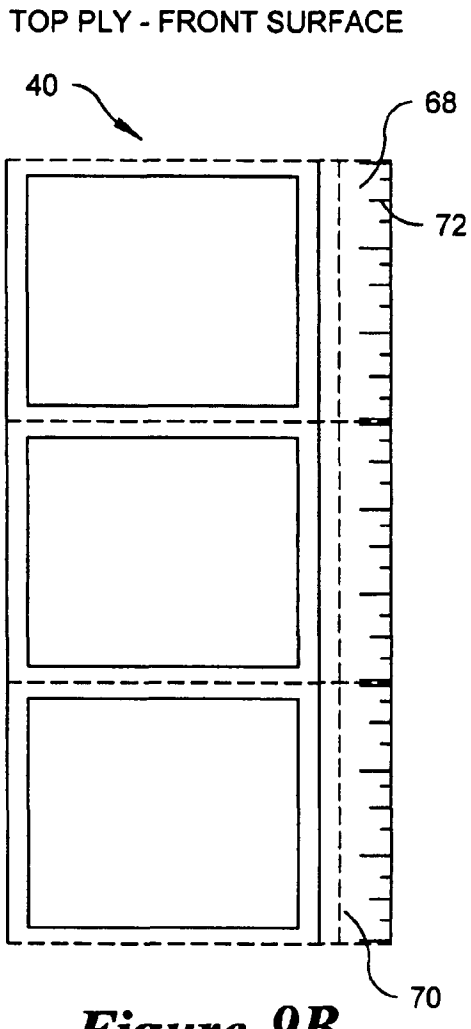
Figure 9A:
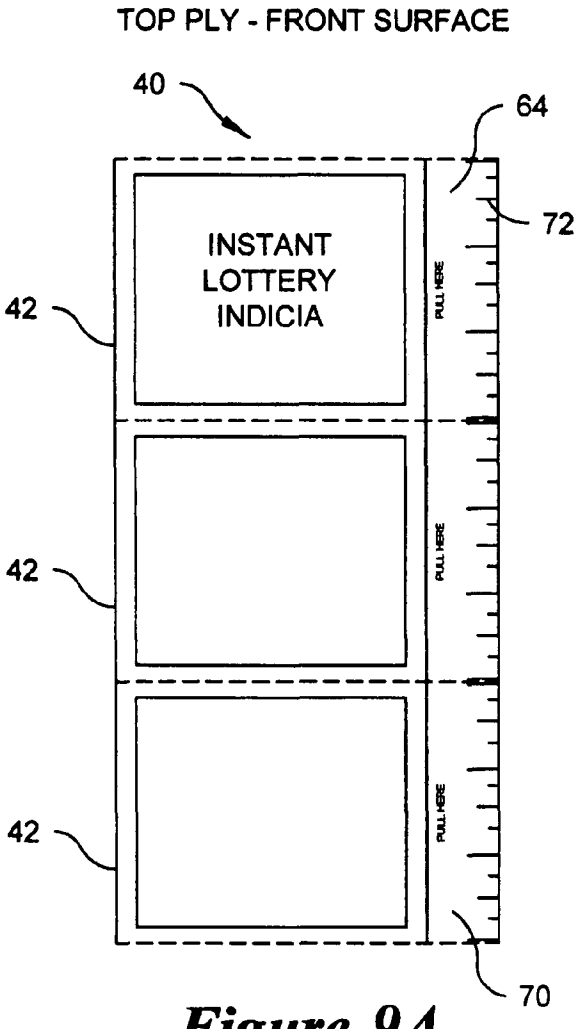

FIGS. 9A-9C show strips 40 of tickets 42 wherein a side edge region 70 of each ticket 42 includes ruler markings 72 that extend continuously from ticket to ticket. The length of the ruler markings for a predetermined plurality of tickets 42 on a strip 40 is equal to a standard unit of length, such as a foot, a yard, or a meter. In the examples shown in FIGS. 9A-9C, each ticket is 1½ inches, so there are eight tickets in a foot of tickets and 24 tickets in a yard of tickets. The tickets 42 may be advertised to encourage a purchaser to buy a standard unit of length of tickets, such as "Buy them by the foot," or "Buy them by the yard."

The side edge region 70 may coincide with an edge region 64 (either with or without adhesive) between plies (FIG. 9A), or it may coincide with a security panel 68 (FIG. 9B), or it may simply be printed along a side edge that remains on the ticket 42 after removal of a security panel 68 (FIG. 9C—with or without adhesive between plies in an edge region 64).

FIGS. 9A-9C show examples of placing the ruler markings 72 on scratch-off type instant lottery tickets. However, the ruler markings 72 may be used on any strip of chance-type tickets that are interconnected end-to-end with rows of perforations that extend widthwise across the strip and that separate and define individual tickets.

Figure 10C:
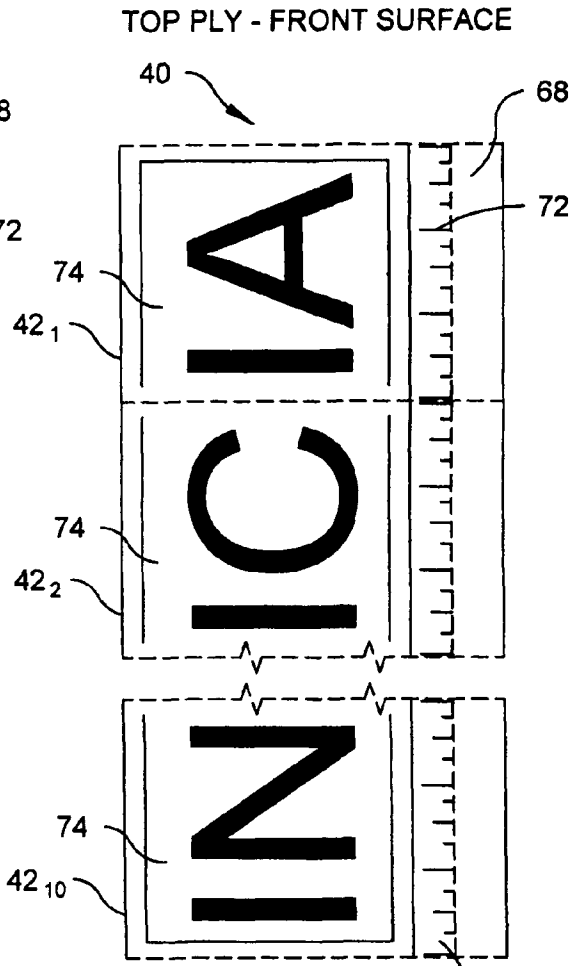
FIGS. 10A-10C shows strips of tickets having multi-ticket indicia thereon in accordance with another embodiment of the present invention.
Figure 10B:
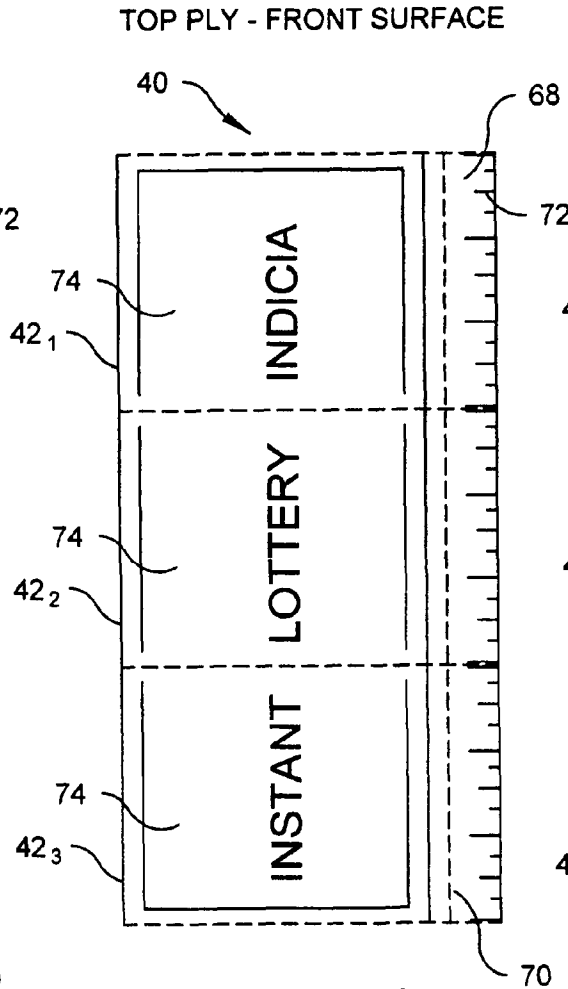
Figure 10A:
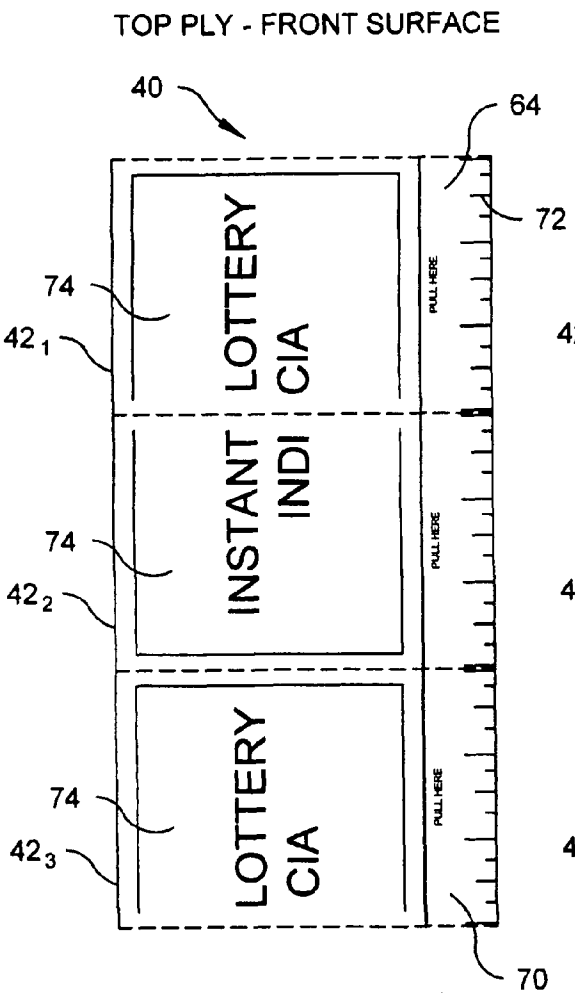

FIGS. 10A-10C show strips 40 of tickets 42 wherein multi-ticket indicia instant lottery indicia 74 spans a group of adjacent tickets 42 in the strip 40 and repeats for successive groups of adjacent tickets 42, such as every two tickets (FIG. 10A), every three tickets (FIG. 10B), or every ten tickets (FIG. 10C). The ruler markings 72 are optional in this embodiment. Multi-ticket indicia may also be used on other forms of chance-type tickets, such as pull tab tickets.

Figure 1B:
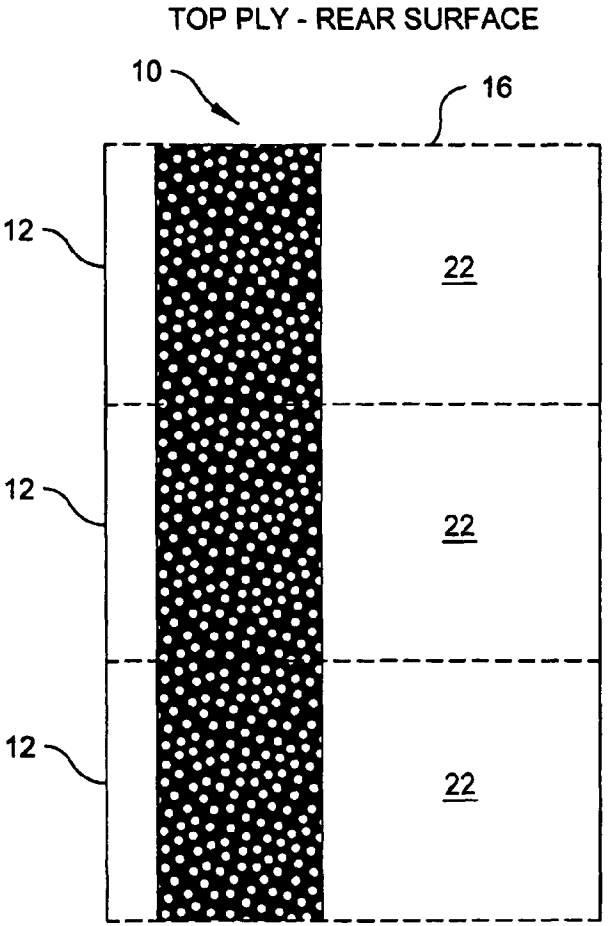
Figure 1B (Prior Art)
FIGS. 1A-1D show the front and rear surfaces of the top ply and base ply of a strip of prior art phone card sold with a sweepstakes feature.
Figure 1A:
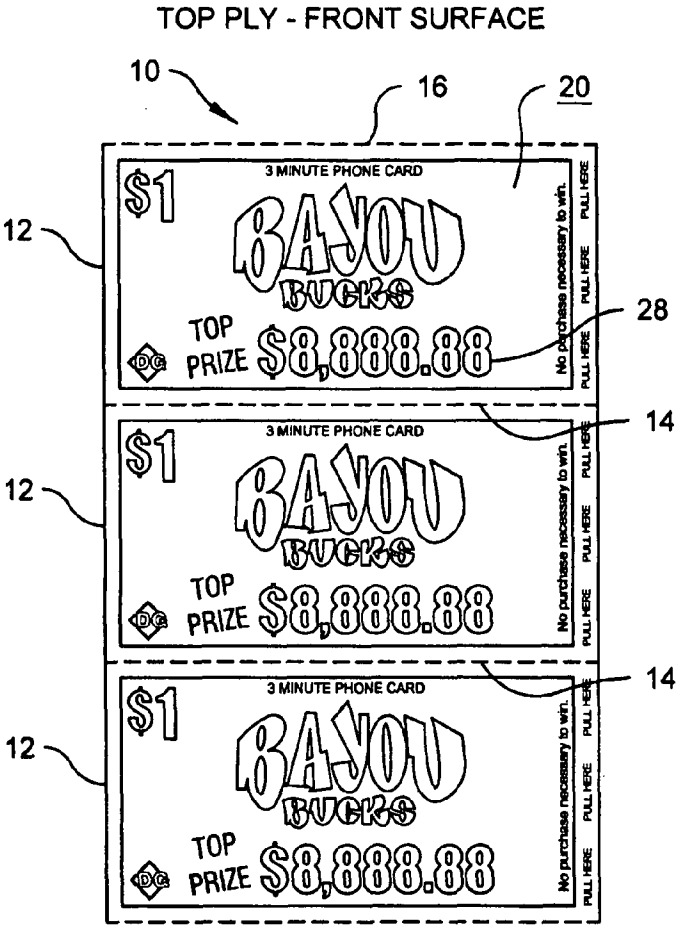
Figure 1A (Prior Art)
Figure 1D:
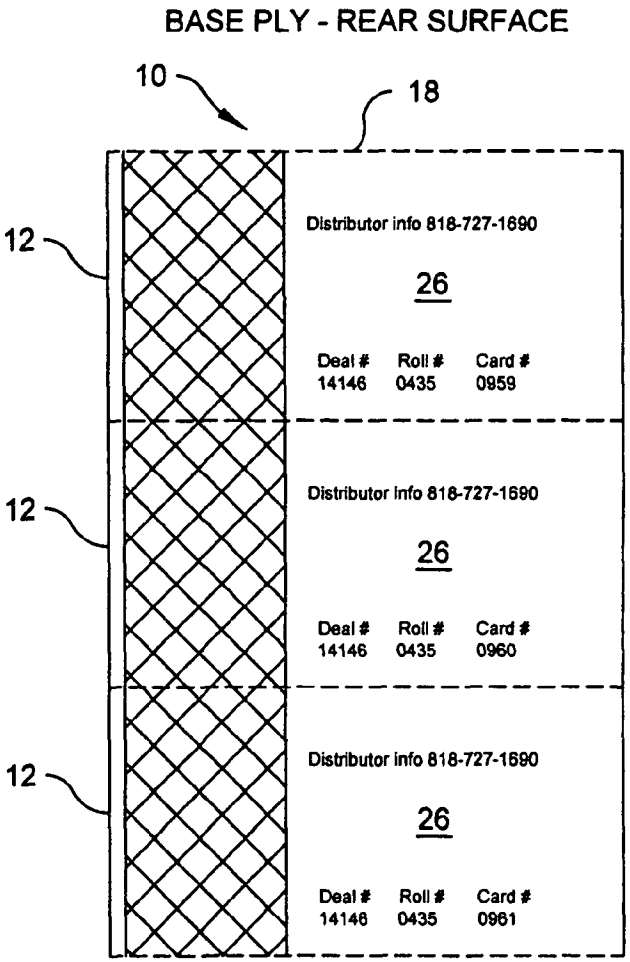
Figure 1D (Prior Art)
Figure 1C:
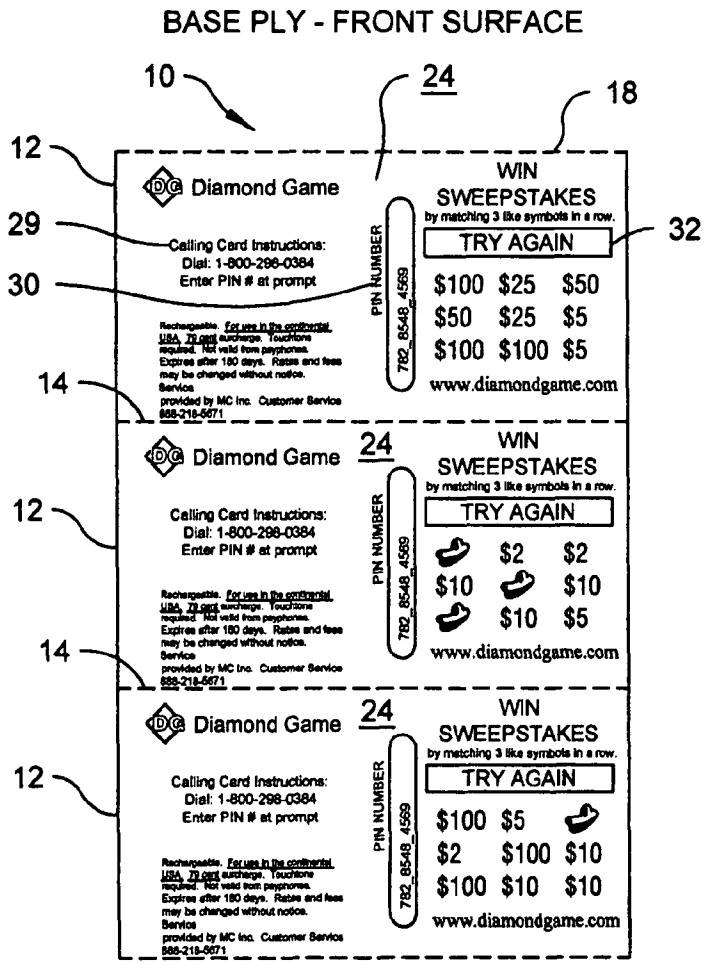
Figure 1C (Prior Art)
Figure 2:
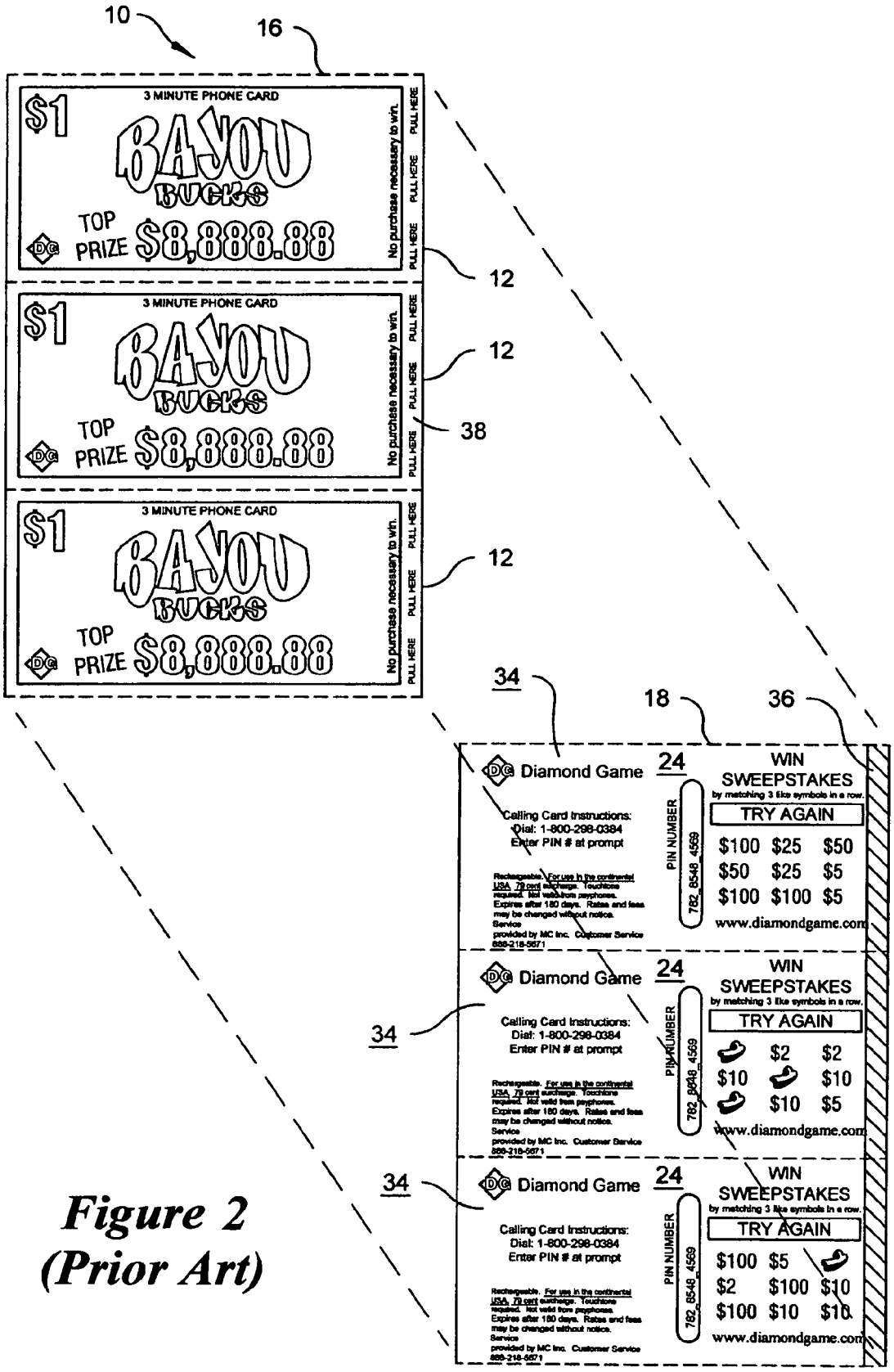
Figure 2 (Prior Art)
FIG. 2 shows an exploded view of a strip of phone cards shown in FIGS. 1A-1D.

FIG. 11 shows an enlarged view of the one of the tickets in FIG. 1C.

The strips of tickets described in the present invention may be stored as a reel of tickets or as a fanfolded or accordion-folded stack of tickets and may be dispensed from a machine or manually by a clerk.

The lottery tickets of the present invention must be purchased to play the instant lottery, and thus are fundamentally different than the sweepstakes freebie associated with prior art phone cards. The lottery tickets of the present invention provide a format that encourages purchase of multiple tickets in a single transaction, while simultaneously meeting the strict standards of state lottery commissions for ticket security. Furthermore, the lottery tickets of the present invention allow multiple tickets to be played more quickly than scratch-off tickets.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention.

What is claimed is:

1. A strip of two-ply instant lottery tickets interconnected end-to-end with rows of perforations that extend widthwise across the strip and that separate and define individual tickets, each ticket having a top ply and a base ply, each with a front and rear surface, the front surface of the base ply having pre-printed instant lottery indicia thereon that are hidden from view by the top ply, and the front surface of the base ply having instant lottery results thereon, a first and a second security panel flanking opposite edges, wherein longitudinal perforations extend lengthwise along the strip of tickets between outer edges of the lottery tickets and inner edges of the security panels, the perforations of the first security panel extending through the top ply and the base ply thereby allowing the first security panel of each ticket to be torn off, the perforations of the second security panel extending only through the top ply thereby inhibiting the second security panel from being torn off, so that if the first security panel of an end ticket in the strip is torn off and the top ply of the end ticket is pulled perpendicular to the widthwise perforations, the top ply of all of the tickets in the strip release from their respective base plies in one continuous strip and without severing any of the rows of perforations associated with the plurality of tickets, the instant lottery results for the strip of tickets thereby being simultaneously revealed with one motion.

2. The strip of lottery tickets of claim 1 wherein a side edge of each ticket includes ruler markings which extend continuously from ticket to ticket.

3. The strip of lottery tickets of claim 2 wherein the length of the ruler markings for a predetermined plurality of tickets are equal to a standard unit of length.

4. The strip of lottery tickets of claim 3 wherein the length is selected from the group consisting of a foot, a yard, and a meter.

5. The strip of lottery tickets of claim 1 wherein the first security panel of each ticket includes ruler markings which extend continuously from ticket to ticket.

6. The strip of lottery tickets of claim 5 wherein the length of the ruler markings for a predetermined plurality of tickets are equal to a standard unit of length.

7. The strip of lottery tickets of claim 6 wherein the length is selected from the group consisting of a foot, a yard, and a meter.

8. The strip of lottery tickets of claim 1 wherein the inside edge of each ticket adjacent to the first security panel includes an edge region that is not initially adhesively joined, thereby allowing the top ply of the end ticket to be easily released from the base ply.

9. The strip of lottery tickets of claim 1 further comprising an adhesive disposed between portions of the adjoining surfaces of the top ply and the base ply, the adhesive being sufficiently weak so that if the top ply of an end ticket in the strip is pulled perpendicular to the perforations, the top ply of all of the tickets in the strip release from their respective base plies without severing any of the rows of perforations associated with the plurality of tickets.

10. A strip of two-ply instant lottery tickets interconnected end-to-end with rows of perforations that extend widthwise across the strip and that separate and define individual tickets, each ticket having a top ply and a base ply, each with a front and rear surface, the front surface of the base ply having pre-printed instant lottery indicia thereon that are hidden from view by the top ply, and the front surface of the base ply having instant lottery results thereon, a first and a second security panel flanking opposite edges, wherein longitudinal perforations extend lengthwise along the strip of tickets between outer edges of the lottery tickets and inner edges of the security panels, the perforations of the first and second security panels extending through the top ply and the base ply thereby allowing the first and second security panels of each ticket to be torn off, so that if either the first or second security panel of an end ticket in the strip is torn off and the top ply of the end ticket is pulled perpendicular to the widthwise perforations, the top ply of all of the tickets in the strip release from their respective base plies in one continuous strip and without severing any of the rows of perforations associated with the plurality of tickets, the instant lottery results for the strip of tickets thereby being simultaneously revealed with one motion.

11. The strip of lottery tickets of claim 10 wherein a side edge of each ticket includes ruler markings which extend continuously from ticket to ticket.

12. The strip of lottery tickets of claim 11 wherein the length of the ruler markings for a predetermined plurality of tickets are equal to a standard unit of length.

13. The strip of lottery tickets of claim 12 wherein the length is selected from the group consisting of a foot, a yard, and a meter.

14. The strip of lottery tickets of claim 10 wherein the first security panel of each ticket includes ruler markings which extend continuously from ticket to ticket.

15. The strip of lottery tickets of claim 14 wherein the length of the ruler markings for a predetermined plurality of tickets are equal to a standard unit of length.

16. The strip of lottery tickets of claim 15 wherein the length is selected from the group consisting of a foot, a yard, and a meter.

17. The strip of lottery tickets of claim 10 wherein the inside edge of each ticket adjacent to the first security panel includes an edge region that is not initially adhesively joined, thereby allowing the top ply of the end ticket to be easily released from the base ply.

18. The strip of lottery tickets of claim 10 further comprising an adhesive disposed between portions of the adjoining surfaces of the top ply and the base ply, the adhesive being sufficiently weak so that if the top ply of an end ticket in the strip is pulled perpendicular to the perforations, the top ply of all of the tickets in the strip release from their respective base plies without severing any of the rows of perforations associated with the plurality of tickets.

19. A strip of two ply chance-type tickets interconnected end-to-end with rows of perforations that extend widthwise across the strip and that separate and define individual tickets, the top ply of all the tickets in the strip release from their respective base plies without severing any of the rows of perforation associated with the tickets and a side edge of each ticket including ruler markings which extend continuously from ticket to ticket.

20. The strip of lottery tickets of claim 19 wherein the length of the ruler markings for a predetermined plurality of tickets are equal to a standard unit of length.

21. The strip of lottery tickets of claim 20 wherein the standard unit of length is selected from the group consisting of a foot, a yard, and a meter.

22. The strip of tickets of claim 19 wherein the tickets are instant lottery tickets.

23. The strip of tickets of claim 19 wherein the tickets are pull tab tickets.

* * * * *